US005573429A

United States Patent [19]

Miyazaki et al.

[11] Patent Number: 5,573,429

[45] Date of Patent: Nov. 12, 1996

[54] WIRE HOLDER FOR A WATER-PROOF CONNECTOR HAVING A U-SHAPED HOLDER MEMBER AND RUBBER PLUG

[75] Inventors: Sho Miyazaki; Eiji Saijo, both of Yokkaichi, Japan

[73] Assignee: Sumitomo Wiring Systems, Ltd., Mie, Japan

[21] Appl. No.: 298,661

[22] Filed: Aug. 31, 1994

[30] Foreign Application Priority Data

Sep. 20, 1993 [JP] Japan ..... 5-257649

[51] Int. Cl.[6] ..... H01R 13/40

[52] U.S. Cl. ..... 439/587

[58] Field of Search ..... 439/587, 589, 439/274, 275, 279

[56] References Cited

U.S. PATENT DOCUMENTS

| | | | |
|---|---|---|---|
| 4,722,696 | 2/1988 | Bullhause | 439/275 |
| 4,735,581 | 4/1988 | Endo et al. | 439/587 |
| 5,098,315 | 3/1992 | Scowen | 439/587 |
| 5,356,312 | 10/1994 | Abe et al. | 439/587 |

FOREIGN PATENT DOCUMENTS

| | | |
|---|---|---|
| 2592235 | 6/1987 | France . |
| 3322809 | 1/1985 | Germany . |
| 61-197668 | 12/1986 | Japan . |
| 63-4081 | 1/1988 | Japan . |
| 4-10975 | 1/1992 | Japan . |
| 2187896 | 9/1987 | United Kingdom . |
| 2207817 | 2/1989 | United Kingdom . |

*Primary Examiner*—Neil Abrams
*Assistant Examiner*—Barry Matthew L. Standig
*Attorney, Agent, or Firm*—Oliff & Berridge

[57] ABSTRACT

A wire holder for a water-proof connector is coupled to an electrical wire which, together with a sealing rubber plug, is inserted into the housing of said water-proof connector. The wire holder has a regulating portion which is fixedly arranged behind the rubber plug, and fitted on the electrical wire extended from the housing, to regulate the bending position of the electrical wire.

5 Claims, 2 Drawing Sheets

WIRE HOLDER FOR A WATER-PROOF CONNECTOR HAVING A U-SHAPED HOLDER MEMBER AND RUBBER PLUG

BACKGROUND OF THE INVENTION

This invention relates to a wire holder for a water-proof connector which suitably enhances the water-proof characteristic of the water-proof connector.

One example of a conventional method of inserting an electrical wire into a water-proof connector is as follows: As shown in FIG. 5, a rubber plug 102 is mounted on the electrical wire 101 in advance, and the latter 101 together with the rubber plug 102 is press-fitted into a cylindrical structure 104 which is connected to the rear end face of a connector housing 103, so that the latter 103 is held water-tight. The rubber plug 102 is, in general, in the form of a cylinder having an insertion hole 102*a* into which the electrical wire 101 is inserted, and a plurality of flange-shaped seals on the outer cylindrical surface. The water-proofing function of the rubber plug 102 attributes both to the elastic force which is provided by the rubber plug 102 when the electrical wire 101 is inserted into the rubber plug 102 under pressure, and to the elastic force which, when the seals of the rubber plug are press-fitted into the cylindrical structure 104 of the housing 103, is provided radially outwardly of the cylindrical structure 104.

Depending on the wiring arrangement, sometimes it is impossible to lay the electrical wire 101 straight; that is, it is forced to bend the electrical wire 101 as shown in FIG. 5. In this case, the bending force acts on the wall 110 of the rubber plug 102 on the side towards which the electrical wire 101 is bent, thus contracting it. As a result, on the opposite side, a gap 111 is formed between the electrical wire 101 and the insertion hole 102*a* of the rubber plug 102. Hence, water may enter the connector through the gap thus formed.

SUMMARY OF THE INVENTION

In view of the foregoing, an object of this invention is to provide a wire holder for a water-proof connector which is able to suitably maintain the connector water-proof even in the case where it is required to bend the electrical wire near the rear end of the connector.

The foregoing object of the invention has been achieved by the provision of a wire holder for a water-proof connector which is coupled to an electrical wire which, together with a sealing rubber plug, is inserted into the housing of the water-proof connector; in which, according to the invention, the wire holder has a regulating portion which is fixedly arranged behind the rubber plug, and fitted on the electrical wire extended from the housing, to regulate the bending position of the electrical wire.

The use of the wire holder is advantageous as follows: In the case where it is required to lay the electrical wire laterally of the housing of the water-proof connector, the electrical wire may be bent at the regulating portion of the wire holder but it is not between the rubber plug and the regulating portion. In other words, when the electrical wire is extended laterally of the housing, the bending force acts on the wire holder but not on the rubber plug. This prevents the deformation of the rubber plug, so that the connector is held water-tight.

As was described above, the wire holder according to the invention has the regulating portion which regulates the bending position of the wire behind the rubber plug, to prevent the action of the bending force on the rubber plug. Hence, even when the electrical wire is laid laterally of the housing of the water-proof connector, no gap is formed between the electrical wire and the rubber plug; that is, the water-proof connector is positively maintained water-proof at all times. This effect should be highly appreciated.

DETAILED DESCRIPTION OF THE PREFERRED EMBODIMENTS

Preferred embodiments of the invention will be described with reference to the accompanying drawings.

Figure 1:
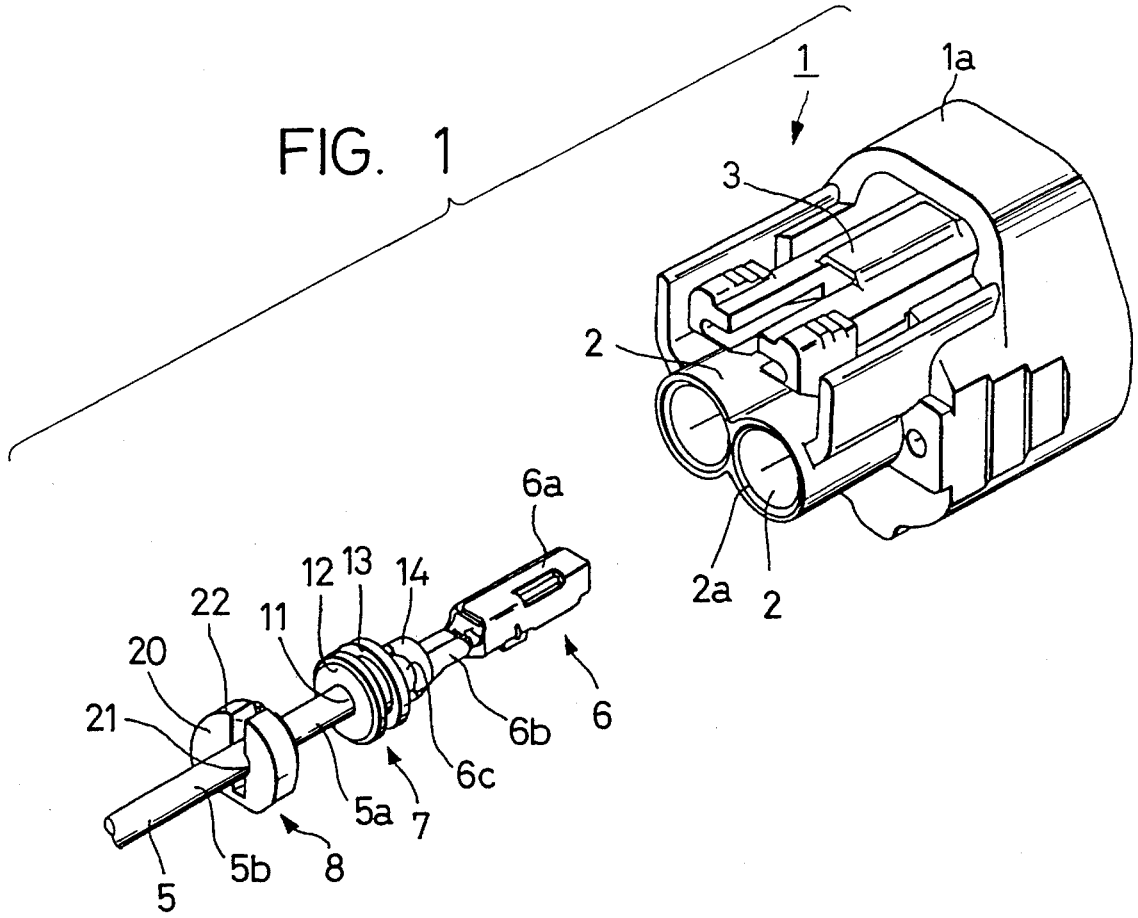
FIG. 1 is an exploded perspective view of a water-proof connector according to one embodiment of the invention.

As shown in FIG. 1, the housing 1 of a water-proof female connector is formed as one unit by using synthetic resin. The larger part of the front half of the housing 1 serves as a joining portion la which is used to connect the water-proof female connector to its mating water-proof male connector (not shown). In the upper portion of the rear half of the water-proof female connector, two wire inserting cylinders 2 are provided in such a manner that they are in parallel with each other and segregated from each other. In addition, in the upper portion of the rear half of the water-proof female connector, an elastic deforming piece 3 is provided which is elastically deformed to engage with the housing of the male connector (not shown).

A female metal terminal 6 is fixedly connected to the end portion of an insulated wire 5 by crimping, which is inserted into the aforementioned wire inserting cylinder 2. The female metal terminal 6 comprises: a female terminal portion 6*a* at the front end; a middle portion 6*b* which is fixedly crimped over the conductor of the insulated electrical wire 5; and a rear portion 6*c* which is connected to the front end portion of a sealing rubber plug 7 by caulking. The rubber plug 7 has a cylindrical body 12 with a through-hole 11 at the center into which the insulated wire 5 is inserted. The cylindrical body 12 is made up of a front half which is fastened to the female metal terminal 6, and a rear half which is larger in diameter than the front half, and has a plurality of flange-shaped seals 13 which are radially outwardly extended from the outer cylindrical surface of the cylindrical body 12.

Figure 2A:
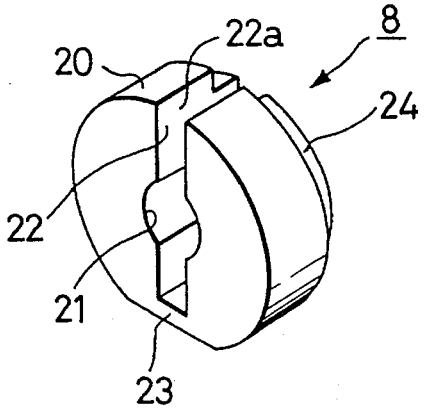
FIGS. 2(A) and 2(B) are a perspective rear view and a perspective front view of a wire holder, respectively.
Figure 2B:
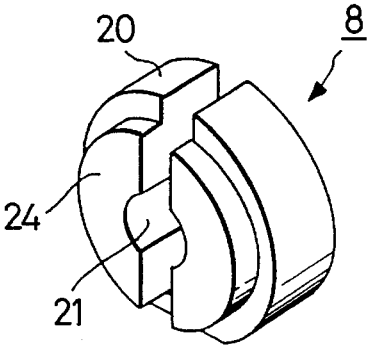
Figure 3:
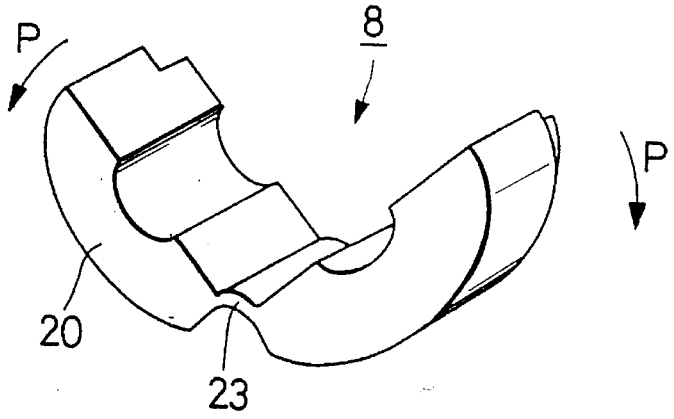
FIG. 3 is a perspective view showing the wire holder which is opened right and left.

A wire holder 8 is made of rubber or synthetic resin which is harder than the rubber plug 7. The wire holder 8, as shown in FIGS. 2(A) and 2(B), includes a substantially disk-shaped regulating portion 20 which has an insertion hole 21 at the center into which the insulated wire 5 is inserted. The regulating portion 20 has a groove 22*a* which is straightly cut from the outer cylindrical surface of the regulating portion 20 through the central insertion hole 21 terminating with a hinge piece 23 left at the end. Hence, the wire holder 8 can be opened with the hinge piece 23 as a fulcrum as shown in FIG. 3. A fitting portion 24 is protruded from one end face (shown in FIG. 2(B)) of the regulating portion 20, which is slightly smaller in diameter than the latter 20 so that it can be press-fitted into the wire inserting cylinder 2 of the housing 1.

Now, an example of an operation of inserting the insulating wire 5 into the female connector will be described.

First, the insulate wire 5, to which the female metal terminal 6 and the rubber plug 7 have been connected, is inserted into the wire inserting cylinder 2 of the housing 1 of the female connector in advance. When the rubber plug 7 is inserted into the wire inserting cylinder 2, the plurality of flange-shaped seals are also inserted thereinto while being held in close contact with the inner cylindrical surface of the wire inserting cylinder 2. In addition, the insulated wire 5 has been sealingly inserted into the through-hole 11 of the rubber plug 7 with no gap between the plug 7 and the insulated wire 5. Hence, the wire inserting cylinder 2 into which the insulated wire has been inserted is held water-tight, being protected from the entrance of water.

Next, the wire holder 8 is mounted on the insulated wire 5 behind the rubber plug 7. More specifically, the wire holder 8 is opened right and left of the hinge piece 23, and then mounted on the insulated wire 5 in such a manner that the latter 5 is engaged with the insertion hole 21, and under this condition, the wire holder 8 is closed. That is, the insulated wire 5 is clamped by the wire holder 8. The wire holder 8 thus mounted is moved towards the rubber plug 7 along the insulated wire 5 so that the fitting portion 24 is press-fitted in the wire inserting cylinder 2. Thus, the wire holder 8 is fixedly held by the wire inserting cylinder 2, and fixedly holds the insulated wire 5 in the insertion hole 21.

When the fitting portion 24 of the wire holder 8 is inserted into the wire inserting cylinder 2 until it is engaged with the opening **2*a* of the latter 2, then the insulated wire 5 is made straight between the rubber plug 7 and the wire holder 8 inside the wire inserting cylinder 2, and it is free outside the latter 2. That is, the insulated wire 5 has a straight portion 5*a* inside the wire inserting cylinder 2, and a free portion 5*b* behind the wire holder 8**.

In the case where the free portion **5*b* of the insulated wire 5 is bent near the end of the housing 1, the bending position of the insulated wire 5 is regulated to come behind the rubber plug 7 with the aid of the wire holder 8, and the bending force is applied to the wire holder 8 only. Hence, the straight portion 5*a* is maintained substantially straight, and no bending force acts on the rubber plug 7. Hence, no gap is formed between the through-hole 11 of the rubber plug 7 and the insulated wire 5**, which prevents the entrance of water. That is, the female connector is positively maintained water-proof.

In the above-described operation of inserting the insulated wire into the connector, the wire holder 8 is mounted on the insulated wire 5 after the latter 5 has been inserted into the wire inserting cylinder 2; however, the invention is not limited thereto or thereby. For instance, it may be mounted on the insulated wire 5 at the same time that the latter 5 is inserted into the wire inserting cylinder 2.

Furthermore, in the above-described embodiment, the rubber plug 7 is separated from the wire holder 8; however, they may be formed as one unit.

In addition, in the above-described embodiment, the wire holder 8 is engaged with the wire inserting cylinder 2; however, the invention is not limited thereto or thereby. For instance, the wire holder 8 may be so designed that it is set outside the wire inserting cylinder 2 and fixed there independently.

Figure 4:
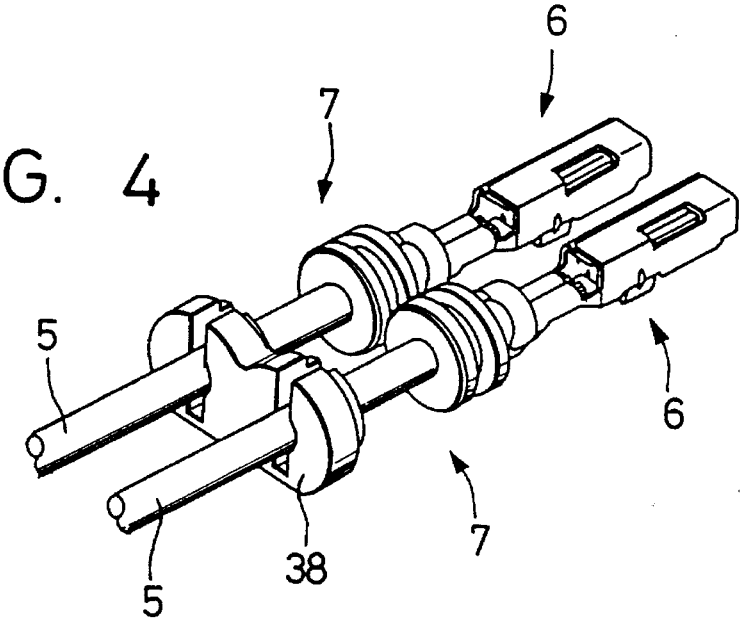
FIG. 4 is a perspective view showing another embodiment of the invention.
Figure 5:
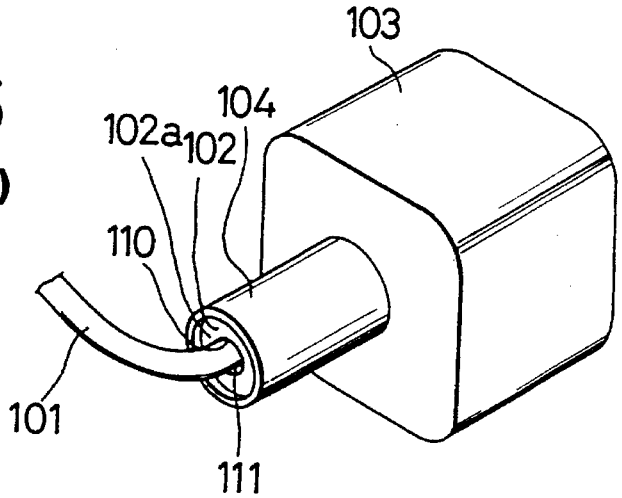
FIG. 5 (PRIOR ART)
FIG. 5 is a perspective view showing a conventional water-proof connector.

Moreover, in the above-described embodiment, the wire holders 8 are provided for the insulated wires 5, respectively; however, the invention is not limited thereto or thereby. For instance, the two wire holders may be combined into one wire holder 38 as shown in FIG. 4, which clamps two insulated wires 5 and regulates the bending of the latter 5.

Additionally, in order to close the regulating portion 20 of the wire holder 8 which has been split with the groove 22, the wire holder 8 may be so modified that the right and left parts of the regulating portion 20 have engaging means. In this case, the connection of the insulated wire to the connector can be achieved merely by inserting the insulated wire 5 into the wire inserting cylinder 2 on which the rubber plug 7 and the wire holder 8 thus modified is mounted. In this case, the assembling work can be achieved with higher efficiency.

What is claimed is:

1. A wire holder for a water-proof connector which is coupled to an electrical wire which is inserted into a housing of the water-proof connector, said wire holder comprising:

a sealing rubber plug fitted on the electrical wire for sealing between the electrical wire and the housing of the water-proof connector; and a U-shaped holder member including a regulating portion which is fixedly arranged behind said rubber plug and fitted and clamped on the electrical wire extended from said housing to regulate a bending position of the electrical wire, the U-shaped holder member having two side portions connected by a hinge piece.

2. A wire holder according to claim 1, wherein said holder member further includes an insertion hole at the center into which the electrical wire is inserted and a groove which is straightly cut from the outer cylindrical surface of said regulating portion through said insertion hole.

3. A wire holder for a water-proof connector which is coupled to an electrical wire which, together with a sealing rubber plug, is inserted into the housing of said water-proof connector, wherein said wire holder has a regulating portion which is fixedly arranged behind said rubber plug, and fitted and clamped on said electrical wire extended from said housing, to regulate the bending position of said electrical wire.

4. A wire holder for a water-proof connector coupled to an electrical wire insertable into a housing of the water-proof connector, said wire holder comprising:

a sealing rubber plug fitted on the electrical wire for sealing between the electrical wire and the housing of the water-proof connector; and a U-shaped holder member including a regulating portion fixedly arranged behind said rubber plug and fitted on the electrical wire extended from said housing to regulate a bending position of the electrical wire, the U-shaped holder member having two side portions connected by a hinge piece, wherein the hinge piece comprises a substantially planar member connecting the two side portions.

5. A wire holder according to claim 4, wherein said U-shaped holder member is spaced from said sealing rubber plug at a predetermined distance.

* * * * *